United States Patent [19]

Forman

[11] 4,188,740

[45] Feb. 19, 1980

[54] MIRROR-PICTURE

[76] Inventor: Everett W. Forman, 31 Harper St., Stamford, N.Y. 12167

[21] Appl. No.: 894,191

[22] Filed: Apr. 6, 1978

[51] Int. Cl.[2] ..... G09F 19/16

[52] U.S. Cl. ..... 40/152.1; 248/445; 248/477

[58] Field of Search ..... 40/152.1, 152, 156, 40/158 R, 155, 159, 582, 606; 248/477, 479, 445, 496, 466, 494, 476

[56] References Cited

U.S. PATENT DOCUMENTS

| | | | |
|---|---|---|---|
| 931,291 | 8/1909 | Germain | 248/477 |
| 1,009,727 | 11/1911 | Duigan | 248/477 X |
| 1,027,910 | 5/1912 | Schulz | 248/477 |
| 1,058,348 | 4/1913 | Blumenthal | 40/152.1 |
| 1,391,349 | 9/1921 | Tolton | 40/582 |
| 1,916,667 | 7/1933 | Hoogendyk | 248/445 |

FOREIGN PATENT DOCUMENTS

| | | | |
|---|---|---|---|
| 3483 | 5/1919 | Netherlands | 248/445 |
| 3672 | of 1912 | United Kingdom | 248/445 |

*Primary Examiner*—John F. Pitrelli
*Attorney, Agent, or Firm*—Richard G. Stephens

[57] ABSTRACT

A mirror and picture placed back-to-back in a frame are pivotably attached to a wall to allow the mirror to be positioned substantially horizontally, for viewing by a person in a bed, or concealed against the wall with the picture displayed.

8 Claims, 7 Drawing Figures

MIRROR-PICTURE

Figure 1:
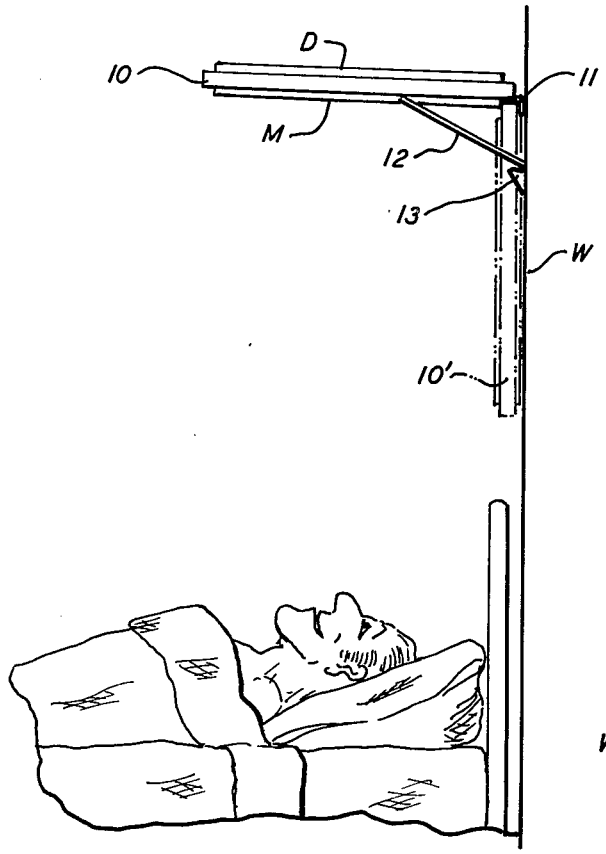

My invention relates to a mirror having a decorative display carried in its rear surface, with means to alternately fix the mirror in a horizontal position reflecting downwardly or to exhibit the decorative display in a vertical position. The invention will find utility in hospitals, nursing homes, and in other residences of bed-ridden individuals. Many such persons frequently desire use of a mirror to facilitate personal grooming, such as shaving, or applying cosmetics or hair combing, which are important to maintain or improve the morale of such persons. While such operations sometimes can be accomplished, generally in a clumsy manner, if a bed-ridden individual holds a portable mirror in one hand, they can be accomplished much more conveniently if the individual need not hold the mirror and can devote both hands to the desired grooming operations. Also, some bed-ridden persons can only use one hand. Attendants and nurses are usually too busy to hold mirrors for bed-ridden patients for the time periods desired, and dependence upon others in order to groom oneself is irritating to many bed-ridden persons. Thus one object of the present invention is to provide a mirror usable by a bed-ridden patient without the patient being required to hold the mirror.

Most bed-ridden patients prefer that their rooms present as "normal" an appearance as possible, i.e. not be fitted with extra contraptions one does not ordinarily find in the room of a well person, and hence it is highly desirable that a mirror made available for use by a bed-ridden person be readily concealable when not needed, such as when the bed-ridden person has visitors. Another object of the invention is to provide a mirror which is readily concealable.

Patient morale usually depends upon the attractiveness of the surroundings, and often can be aided by display of attractive pictures, posters, family photographs or the like. The invention solves each of the three problems of making a mirror available to a bed-ridden patient, making it concealable, and that of attractively decorating a hospital or like room, and provision of a simple and economical device which solves all three such problems is an object of the invention.

The invention also may find utility as an erotic bedroom aid, allowing a person lying on his or her back to observe sexual procedures in the mirror, but allowing the mirror to be concealed when not in use in order to avoid embarrassment, and provision of such a concealable mirror-display is another important object of the invention.

Other objects of the invention will in part be obvious and will in part appear hereinafter.

The invention accordingly comprises the features of construction, combination of elements, and arrangement of parts, which will be exemplified in the constructions hereinafter set forth, and the scope of the invention will be indicated in the claims.

For a fuller understanding of the nature and objects of the invention reference should be had to the following detailed description taken in connection with the accompanying drawings, in which:

FIG. 1 is a diagrammatic side elevation view illustrating one form of the invention shown positioned with the mirror in use in solid lines, and shown in dashed lines positioned so that the mirror is concealed and a decorative display on the opposite side from the mirror is exhibited.

Figure 2C:
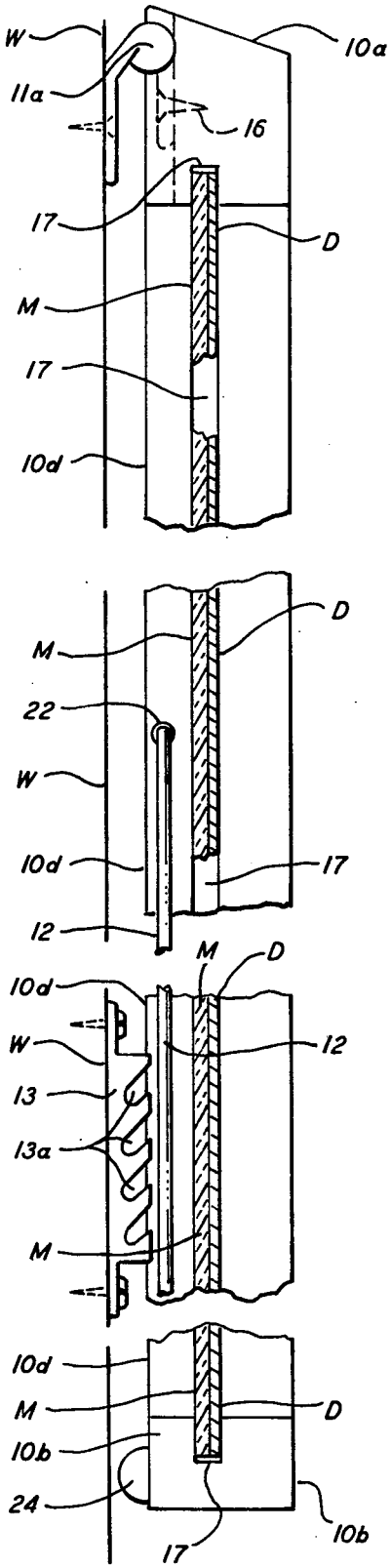
Figure 2B:
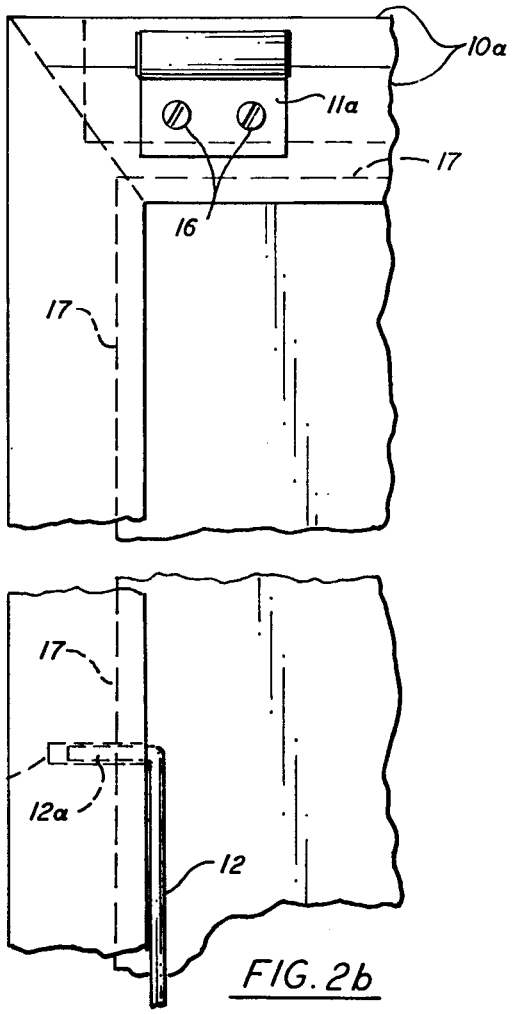
Figure 2A:
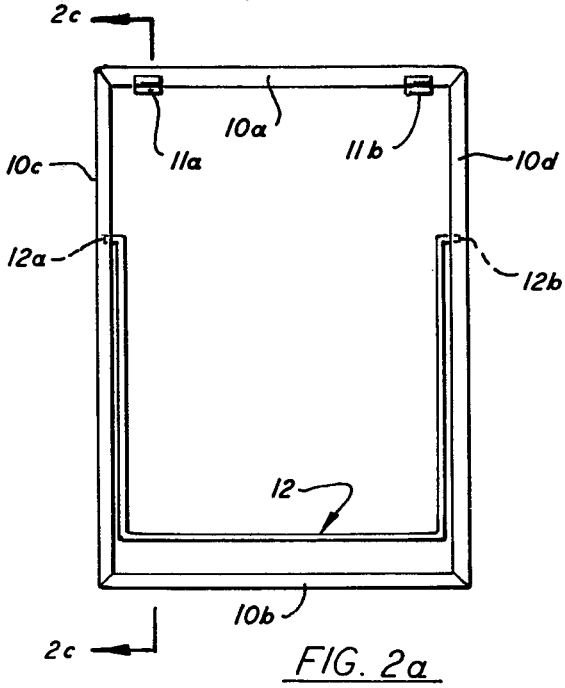

FIG. 2*a* is a mirror-side view of a preferred form of the invention.

FIG. 2*b* is an enlarged fragmentary view illustrating portions of the left side of FIG. 2*a*.

FIG. 2*c* is a cross-section view taken at lines 2*c* —2*c* in FIG. 2*a*.

Figure 3A:
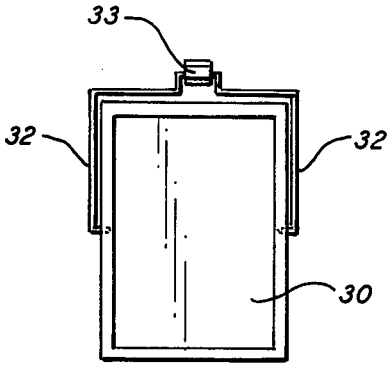
Figure 3B:
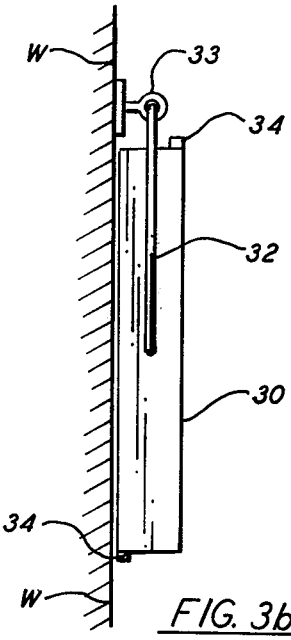
Figure 3C:
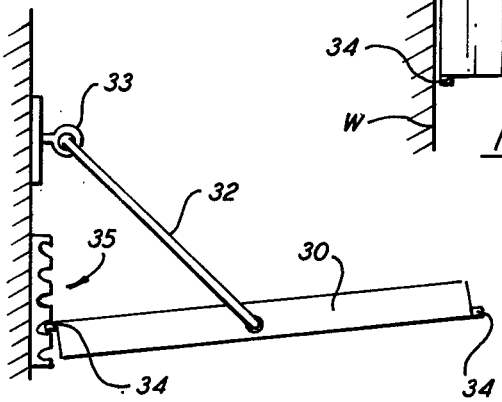

FIGS. 3*a*,3*b* and 3*c* are a front view and two side views illustrating an alternative form of the invention in two alternate positions.

Referring to FIG. 1, the invention is diagrammatically shown in solid lines as comprising a frame 10 having a mirror surface M visible from one side and a decorative display D visible on its other side. The frame is connected at its top by hinge means 11 to vertical room wall W, and a support rod means 12 pivotally attached to frame F extends to and abuts stop means 13 fixedly attached to wall W, thereby supporting the frame in a generally horizontal, but usually in practice, slightly inclined position. With the frame so supported, the mirror surface reflects substantially vertically, and may be viewed substantially perpendicularly by an individual lying in a bed with the head of the bed fairly close to wall W. The more the frame can be inclined upwardly, the further one can locate the head of the bed from a wall and still allow the individual to view the mirror substantially perpendicularly. With the device in the position shown, a person lying in bed can perform grooming operations or the like while viewing himself or herself in the mirror, or, if desired, can observe a sexual partner (not shown) also in the bed. When the frame is swung to the alternative position shown in dashed lines and labelled 10', the frame 10 lies flat against wall W and the decorative display D is exhibited, with the mirror surface, and preferably the supporting rod, stop and hinges, entirely concealed, with the frame appearing to a visitor or the like to be an ordinary picture frame.

Details of one form of the invention are further illustrated in FIGS. 2*a* to 2*c*. The frame 10 comprises upper and lower horizontal frame members 10*a*,10*b* interconnected at their ends to the ends of side frame members 10*c*,10*d*. A pair of hinges 11*a*,11*b* are shown secured to the rear side of top frame member 10*a* by screws 16,16. The rear legs of the hinges are bent as shown in FIG. 2*c* to space the hinge axis slightly outwardly from wall W, and the top of frame member 10*a* is tapered downwardly outwardly as shown in FIG. 2*c*, so that no portion of member 10*a* will strike wall W when the device is rotated upwardly (counterclockwise in FIG. 2*c*) through an angle exceeding 90 degrees, such as an angle of 105 degrees. Recesses 17 extending along the inside edges of each of the four frame members fixedly accommodate the outer edges of glass mirror M to hold the mirror in the frame. Mirror M preferably comprises a conventional back-silvered glass plate. Recesses 17 similarly bound the edges of a decorative display card or sheet D which may be, but need not be affixed to the rear side of mirror M. The display card may bear any sort of indicia, of course, including alphanumeric indicia as well as pictorial indicia.

Holes 22 extending outwardly partway through each of side members 10*c* and 10*d* pivotally accommodate or journal the ends 12*a*,12*b* of a rigid, generally U-shaped wire 12. A plural stop means 13 is shown as comprising a member screwed to wall W to provide a plurality of slots 13*a*,13*a* in any of which bottom bar portion 12*c* of support means 12 may be positioned, to support the frame in an inclined position when the mirror is to be used. Positioning bar portion 12c in different ones of the slots supports the mirror at different angular positions. Stop member 13 has a width less than the distance between side members 10c and 10d, and preferably does not project outwardly from wall W as far as the edge of mirror M, so that the mirror cannot strike the stop and be damaged if the frame is accidentally swung down very rapidly. One or more bumpers 24 may be installed on member 10b to limit clockwise (in FIG. 2c) rotation of the frame for the same purpose.

FIGS. 3a to 3c illustrate an alternative form of the invention wherein frame 30, which carries a mirror in one side and a decorative display on the other is pivotally mounted on the ends of a yoke support means 32. The ends of the yoke seat in holes which extend inwardly partway through each side member of the frame, ordinarily midway between the top and bottom of the frame. A central portion of the horizontal upper section of the yoke is journalled in a wall-mounted capture means shown as a tube 33. The device can hang vertically against the wall W as shown in FIG. 3b, or can extend substantially horizontally as shown in FIG. 3c. When moved to the position shown in FIG. 3c, the weight of the device applies an appreciable force normal to the wall surface, so that the device can maintain itself in position without the need for a stop means added onto the wall surface. Pads or strips such as those shown at 34 can be provided if desired on the ends of the frame to enhance frictional engagement with the wall. Alternatively, a stop strip 35 having a plurality of slots to engage the frame and hold it may be used. The top of tube 33 can be cut away, if desired, so that the capture means acts as a simple hook engageable by yoke 32. If should be noted that the device of FIGS. 3a–3c allows the decorative display to be viewed by the patient while in bed, and the mirror to be presented in a vertical position, functions not obtainable with the device of FIGS. 2a–2c. If one merely lifts the frame, to rotate yoke 32 slightly counterclockwise in FIG. 3c one may then rotate the frame 180 degrees to display the other side. The device of FIGS. 3a–3c does have the disadvantage that the support means is not concealed.

It will become apparent that the mirror and display may be oval or circular and various other shapes instead of being rectangular as shown, that the invention may be constructed in a wide variety of sizes, and that numerous details may be altered without departing from the invention. The frame is shown constructed of wood but could be made of plastic or metal. While the frame is shown devoid of exterior ornamentation, it can include various types of ornamentation, such as gilded plaster-of-paris. As thus far disclosed it has been contemplated that the mirror-picture frame be positioned to its alternate position by a standing or erect person, but it should be noted that various cord-pulley and lever devices could be provided to enable a person lying in bed to position the device. In the appended claims the word "sheet" will be used in generic sense to include sheet-like members irrespective of their thickness, and irrespective of whether they carry backings, other stiffeners or coverings.

It will thus be seen that the objects set forth above, among those made apparent from the preceding description, are efficiently attained, and since certain changes may be made in the above constructions without departing from the scope of the invention, it is intended that all matter contained in the above description or shown in the accompanying drawings shall be interpreted as illustrative and not in a limiting sense.

The embodiments of the invention in which an exclusive property or privilege is claimed are defined as follows:

1. A mirror-display device, comprising, in combination: a plate-like mirror and a display sheet bearing indicia; a frame supporting said mirror and display sheet in back-to-back relationship so that the reflecting surface of said mirror is visibly exposed on one side of said frame and said indicia on said display sheet are visibly exposed on the opposite side of said frame; attachment means for attaching said frame to a vertical wall surface to allow rotation of said frame, mirror and display sheet between a first position in which said mirror and display sheet extend substantially vertically with said display sheet exposed and said mirror turned toward said wall surface and concealed, and a second position in which said mirror and display sheet extend substantially horizontally with said mirror reflecting substantially vertically downwardly; and support means for maintaining said frame in said second position, said mirror being inset into said frame to provide a recess bounded by the periphery of said frame, and said attachment means comprising rod means pivotally mounted on said frame to fit within said recess, whereby said rod means will be substantially concealed when said frame lies in said first position.

2. The device of claim 1 wherein said attachment means comprises hinge means connected between said frame and said wall surface, and wherein said support means comprises a stop means affixed to said wall surface, and rod means extending between said frame and said stop means to prevent downward rotation of said frame from said second position.

3. The device of claim 1 wherein said attachment means comprises yoke means having first and second ends pivotally connected to opposite sides of said frame and an intermediate portion adapted to engage capture means carried on said wall surface.

4. The device of claim 2 wherein said hinge means has a hinge axis situated below an upper edge of said frame and spaced outwardly from said wall surface, so that said hinge means is concealed when said frame is in said first position and so that said upper edge of said frame does not engage said wall surface when said frame is in said second position.

5. The device of claim 2 wherein said rod means has first and second ends pivotally attached to said frame on opposite sides of said frame and a portion intermediate said ends adapted to seat on said stop means.

6. The device of claim 2 wherein said mirror is recessed in said frame from said one side of said frame to provide a recess bounded by said mirror and said wall surface when said frame is in said first position, and said rod means is pivotally attached to said frame to lie within said recess when said frame is in said first position.

7. The device of claim 2 wherein said stop means includes a plurality of edges against which said rod means may be positioned to maintain said frame in either said second position or a third position.

8. The device of claim 4 wherein said upper edge of said frame is shaped to extend higher on said one side of said frame than on the opposite side of said frame when said frame is in said first position.

* * * * *